US009222691B2

(12) United States Patent
Ramsay et al.

(10) Patent No.: US 9,222,691 B2
(45) Date of Patent: Dec. 29, 2015

(54) STATIC ROOF VENTILATOR

(75) Inventors: Serge Ramsay, Montreal (CA); Jean-Rock Ramsay, Montreal (CA); Linda Ramsay, legal representative, Montreal (CA)

(73) Assignees: Serge Ramsay, Montreal, Quebec (CA); Jean-Rock Ramsay, deceased, late of Montreal, Quebec (CA); Linda Ramsay, legal representative, Montreal, Quebec (CA)

( * ) Notice: Subject to any disclaimer, the term of this patent is extended or adjusted under 35 U.S.C. 154(b) by 1190 days.

(21) Appl. No.: 12/515,385

(22) PCT Filed: Nov. 17, 2006

(86) PCT No.: PCT/CA2006/001883

§ 371 (c)(1),
(2), (4) Date: May 18, 2009

(87) PCT Pub. No.: WO2008/058359

PCT Pub. Date: May 22, 2008

(65) Prior Publication Data

US 2010/0056038 A1 Mar. 4, 2010

(51) Int. Cl.
*F24F 7/02* (2006.01)

(52) U.S. Cl.
CPC ..... *F24F 7/02* (2013.01)

(58) Field of Classification Search
CPC ..... F24F 7/02; F24F 13/20
USPC ..... 454/364, 365, 366, 367, 339, 33, 36, 454/35, 34, 3, 29, 15, 12, 368; 52/200, 199
See application file for complete search history.

(56) References Cited

U.S. PATENT DOCUMENTS 855,170 A * 5/1907 Kayser ..... 261/48
856,117 A * 6/1907 Waldmire ..... 52/473

(Continued)

FOREIGN PATENT DOCUMENTS

CA 1181281 A 1/1985
CA 2149819 A * 11/1996

(Continued)

OTHER PUBLICATIONS

International Search Report for PCT/CA2006/001883.

*Primary Examiner* — Alissa Tompkins
*Assistant Examiner* — Brittany Towns
(74) *Attorney, Agent, or Firm* — Baker and Hostetler LLP

(57) ABSTRACT

A roof ventilator including: a first module defining a first module passageway having a first passageway longitudinal axis. The first module including a first module louver support extending substantially parallel to the first passageway longitudinal axis and a first module louver for creating a draft within the first module passageway upon wind blowing onto the first module louver. The first module louver extending from the first module louver support, located peripherally relatively to the first module passageway. A second module attached to the first module, defining a second module passageway, in fluid communication with the first module passageway and defining a second passageway longitudinal axis. The second module including a second module louver support, extending substantially parallel to the second passageway longitudinal axis. A second module louver creates a draft within the second module passageway upon wind blowing onto the second module louver. The second module louver extending from the second module louver support located peripherally relatively to the second module passageway. A fastener operatively couples the first and second modules biasing the first and second module louver supports towards each other.

21 Claims, 19 Drawing Sheets

(56) References Cited

U.S. PATENT DOCUMENTS

| | | | | | |
|---|---|---|---|---|---|
| 1,669,722 | A | | 5/1928 | Miller | |
| 1,699,375 | A | | 1/1929 | Renshaw | |
| 1,742,541 | A | * | 1/1930 | Hooper | 454/362 |
| 2,544,182 | A | * | 3/1951 | Roberts | 454/282 |
| 2,556,944 | A | * | 6/1951 | Rhyner | 454/39 |
| 2,742,846 | A | * | 4/1956 | Alward | 454/33 |
| 2,868,106 | A | | 1/1959 | Knutson et al. | |
| 3,209,669 | A | * | 10/1965 | Bayne | 454/368 |
| 3,338,006 | A | | 8/1967 | Belden | |
| 3,426,667 | A | | 2/1969 | Johnson | |
| 3,643,584 | A | * | 2/1972 | Sheppard | 454/275 |
| 4,335,648 | A | * | 6/1982 | Mitchell | 454/33 |
| 4,638,727 | A | * | 1/1987 | Mitchell | 454/33 |
| 4,850,265 | A | | 7/1989 | Raisanen | |
| 5,439,417 | A | | 8/1995 | Sells | |
| 5,655,964 | A | | 8/1997 | Rheault et al. | |
| 6,190,251 | B1 | * | 2/2001 | Park | 454/35 |
| 6,422,936 | B1 | * | 7/2002 | Van Gilst et al. | 454/367 |
| 6,439,991 | B1 | | 8/2002 | Jarnot | |
| 2006/0240762 | A1 | | 10/2006 | Railkar et al. | |
| 2007/0167130 | A1 | * | 7/2007 | Brochu | 454/365 |

FOREIGN PATENT DOCUMENTS

| | | | | |
|---|---|---|---|---|
| CA | 2167041 | A1 | | 7/1997 |
| CA | 2571969 | A1 | | 6/2007 |
| GB | 558805 | A | * | 8/1942 |
| WO | 2005095730 | A1 | | 10/2005 |

* cited by examiner

FIG. 4 Section A-A

FIG. 5 Section B-B

Detail D

Detail E

Detail F

STATIC ROOF VENTILATOR

FIELD OF THE INVENTION

The present invention relates to the general field of ventilation systems and is particularly concerned with a static roof ventilator.

BACKGROUND OF THE INVENTION

Energy efficiency is a serious consideration in building design and construction. Many building codes require builders to minimise energy requirements to maintain comfortable living spaces.

One of the most common energy loss in a building is due to the heat transfer through the attic. In some climates, heat builds up in the attic from solar energy incident on the roof or from heat transfer from the living space. If the attic is allowed to become too warm, the installed insulation becomes ineffective and the attic heat is transferred to the living space below. In colder climates, moisture builds up in the attic, sometimes significantly decreasing the efficiency of the insulation. Regardless of its numerous origins, moisture, if left unchecked, will build up and potentially cause extensive damage within the structure. Moisture originating from the shower, kitchen steam or the like not only potentially decreases the insulating value of the insulating material but also potentially leads to growth of mildew and mould.

Hence, it is relatively well known in the home building industry that proper circulation of air within the attic zone and above the level at which the insulation is installed is essential to avoid moisture build up during cold winter months and to maintain the un-insulated attic space at a reasonably low temperature during warm summer months.

Early efforts at minimising energy losses through the attic focused on the insulation between the living space and the attic have ignored the effects of the heat and/or moisture build-up. As insulation improved, a point was reached where more insulation was not necessarily better or possible due to space limitations. Numerous attempts have been made to alleviate this problem by installing vents at various points in the roofing structure. One common technique is to include vents or venting apertures on the underside of the soffite of the roof as, for example, on the underside of the eaves. While this practice allows some of the heat to escape, the ventilation provided remains poor. Indeed, because the vents are located on the underside of the eaves, the heat must build up to relatively high levels before it is forced downwardly out of the vents due to the fact that the heat naturally rises. This also causes a non-uniform heat distribution within the attic or roof's structure.

Since the heat rises, the temperature closest to the roof will constantly remain at temperatures higher than that of the areas further away from the roof and near the eaves. Also, in sloped roof structures, the heat will concentrate adjacent the apex, creating higher temperatures of the apex which steadily decrease along the roof line towards the eaves. Hence, the air allowed to escape of the eaves is not even the hottest air.

In order to increase ventilation, turbine-type roof ventilators are sometimes used. These turbine roof ventilators typically include a sleeve on the top of which is mounted a rotatable turbine. Typically, the turbine includes a closed circular, usually convex upper end which prevents ingress of rain into the sleeve and thus into the roof chamber. The turbine typically also includes a lower ring and a series of arcuate turbine blades extending from the lower ring to the upper end through which hot air flows. The turbine blades are rotatable due to wind or breezes or to the flow of air from out under the roof through the turbine.

Static roof ventilators, also commonly referred to as "pot vents", are also used extensively to increase ventilation. Conventional static ventilators typically include a flange or base portion, a conduit or duct portion and a hood or cover portion. The flange is typically secured to the roof deck over a similarly sized aperture as with the conduit portion.

Although somewhat useful, some of the prior art ventilators suffer from numerous drawbacks. For example, some prior art ventilators are considered as presenting poor visual aesthetic characteristics and, hence, are generally considered detrimental to the overall aesthetical aspect of buildings. Also, some prior art ventilators being subjected to harsh environmental factors such as rain, snow, wind and the like tend to deteriorate over time. Furthermore, some prior art ventilators are relatively costly to manufacture and tedious to assemble and install.

In addition, static roof ventilators typically define a relatively large empty space. Therefore, a relatively large volume is occupied by these ventilators when they are transported, which raises shipping costs. Furthermore, roof ventilators are typically subjected to relatively strong winds and need to be therefore relatively strong and have therefore been built out of metal. This metallic construction is relatively expensive and relatively time-consuming to manufacture. Also, the use of metals often results in relatively heavy ventilators, which are therefore relatively hard to handle during shipment and installation.

Accordingly, there exists a need in the industry for an improved static roof ventilator.

OBJECT OF THE INVENTION

An object of the present invention is therefore to provide an improved static roof ventilator.

SUMMARY OF THE INVENTION

In a first broad aspect, the invention provides a roof ventilator. The roof ventilator includes:

a first module defining a first module passageway, the first module passageway defining a first passageway longitudinal axis, the first module including a first module louver support extending substantially parallel to the first passageway longitudinal axis and a first module louver for creating a draft within the first module passageway upon wind blowing onto the first module louver, the first module louver extending from the first module louver support, the first module louver being located peripherally relatively to the first module passageway;

a second module attached to the first module, the second module defining a second module passageway, the second module passageway being in fluid communication with the first module passageway and defining a second passageway longitudinal axis, the second module including a second module louver support, the second module louver support extending substantially parallel to the second passageway longitudinal axis and a second module louver for creating a draft within the second module passageway upon wind blowing onto the second module louver, the second module louver extending from the second module louver support, the second module louver being located peripherally relatively to the second module passageway; and a fastener operatively coupled to the first and second modules for attaching the first and second modules to each other and biasing the first and second module louver supports towards each other.

Advantages of the present invention include that the proposed roof ventilator is designed so as to optimize roof ventilation. Also, the proposed roof ventilator is designed so as to provide a relative pleasing aesthetical appearance. Also, the proposed roof ventilator is designed so as to be substantially durable and able to withstand relatively harsh environments.

Still furthermore, the proposed roof ventilator is designed so as to be manufacturable using conventional forms of manufacturing such as injection molding with conventional forms of materials such as conventional polymeric resins in order to provide a roof ventilator that will be economically feasible, long-lasting and relatively trouble-free in operation. Furthermore, the proposed roof ventilator is designed so as to be relatively easy to assemble and install.

In some embodiments of the invention, the proposed roof ventilator has a structure that may withstand relatively large compressive forces. In these embodiments, the fastener may bias the modules towards each other with a relatively large force to achieve a relatively rigid roof ventilator while withstanding tension and shear forces exerted onto the roof ventilator.

In at least one embodiment of the invention, the proposed roof ventilator is of the modular-type including individual sections that may be relatively easily assembled together without requiring special tooling or manual dexterity through a set of relatively quick and ergonomic steps.

Furthermore, in some embodiments of the invention, the proposed ventilator includes modules that may be staked with similar modules in a relatively compact manner to facilitate shipment of the ventilator modules.

Other objects, advantages and features of the present invention will become more apparent upon reading of the following non-restrictive description of preferred embodiments thereof, given by way of example only with reference to the accompanying drawings.

DETAILED DESCRIPTION

Referring to FIGS. 1 to 19, there is shown a roof ventilator 10 in accordance with an embodiment of the present invention. The roof ventilator 10 is a static roof ventilator mountable on a roof of a building substantially in register with an opening formed in the roof of the building (not shown) for improving the ventilation of, for example, the attic thereof. In the embodiments shown throughout the figures, the roof ventilator 10 is shown as having a generally square transversal configuration and a generally parallelepiped shaped overall configuration. It should, however, be understood that the ventilator 10 could have other transversal and over all configurations without departing from the scope of the present invention.

Figure 1:
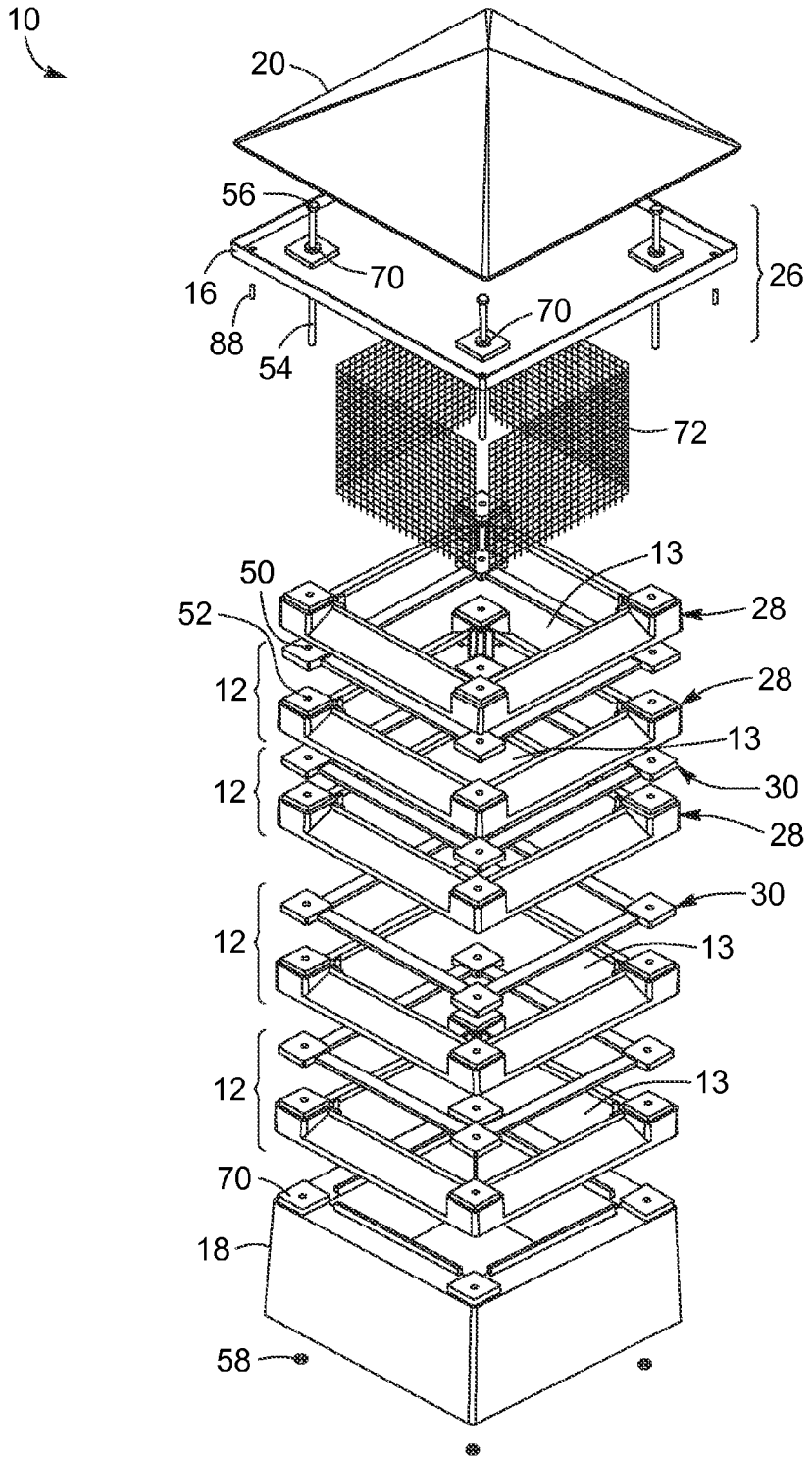
FIG. 1: in an exploded view, illustrates a modular roof ventilator in accordance with an embodiment of the present invention.
Figure 2:
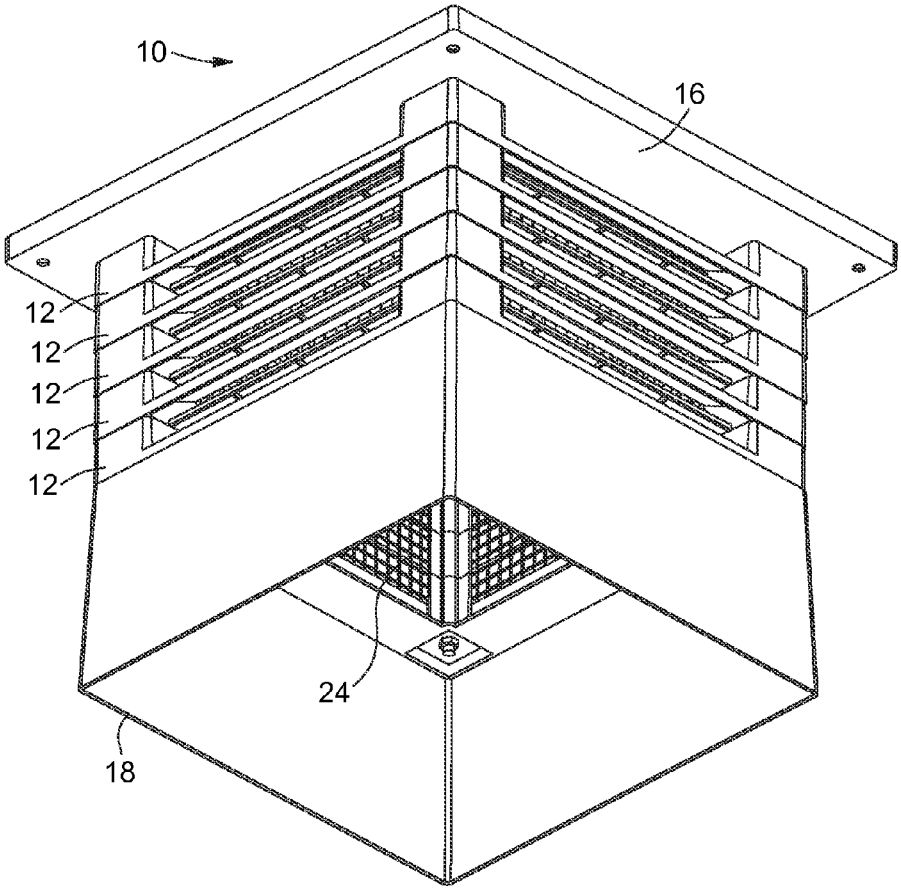
FIG. 2: in a bottom perspective view, illustrates the roof ventilator shown in FIG. 1 in an assembled configuration.
Figure 3:
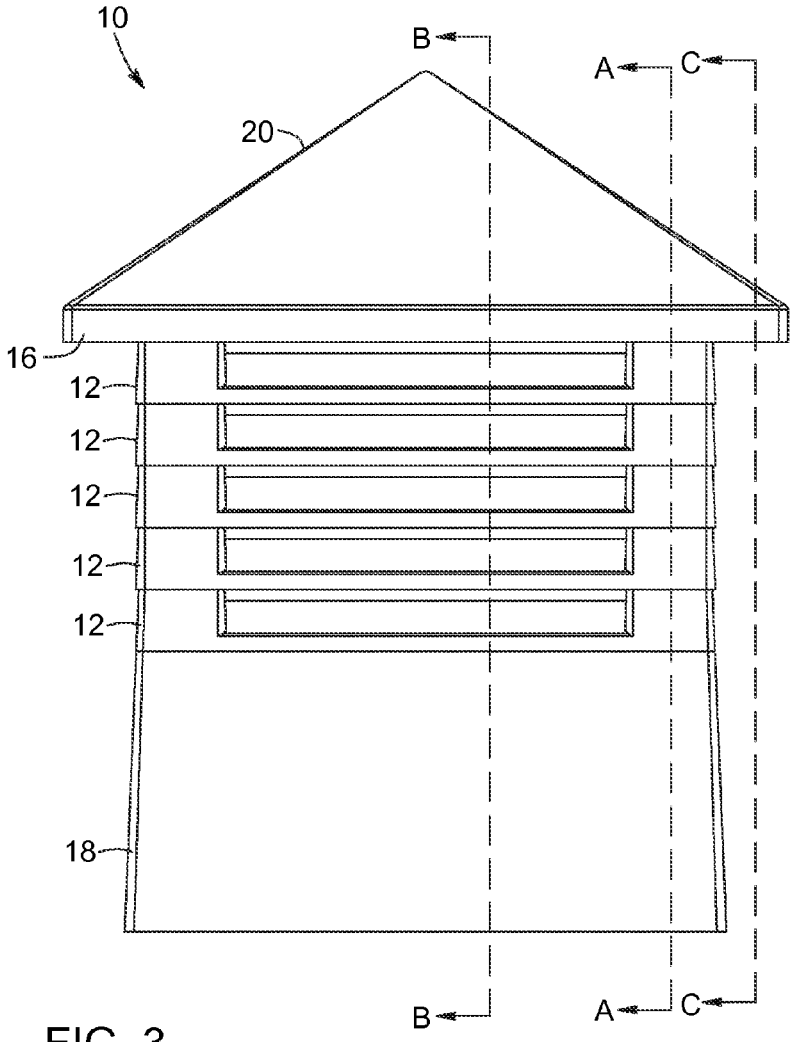
FIG. 3: in a side elevational view, illustrates the roof ventilator shown in FIGS. 1 and 2.
Figure 4:
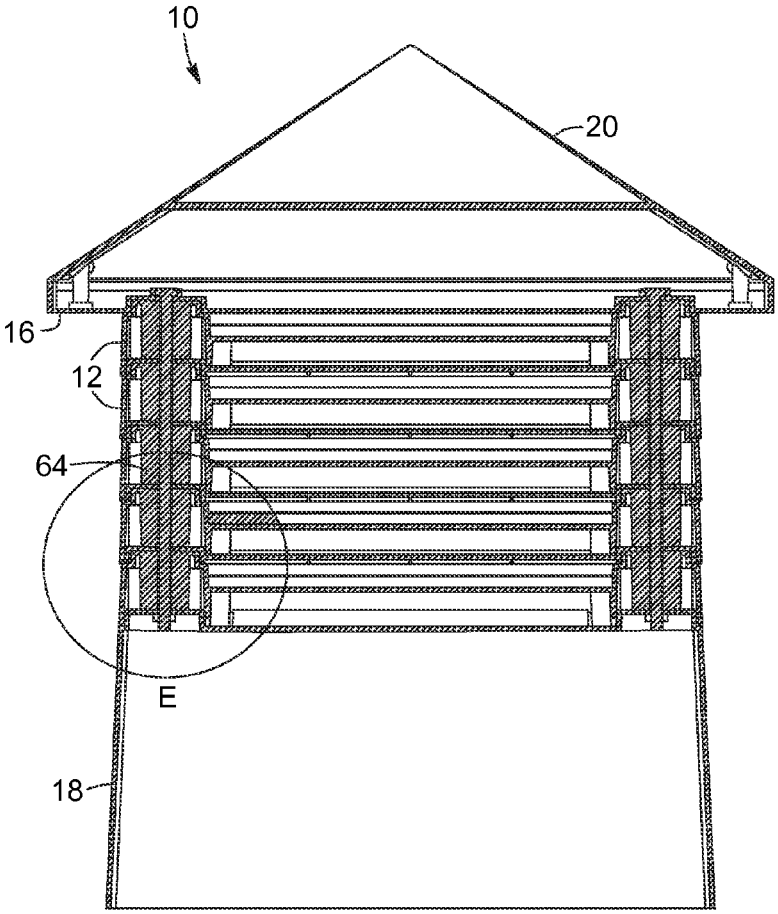
FIG. 4: in cross-sectional view taken along arrows A-A of FIG. 3, illustrates some of the features of the roof ventilator shown in FIGS. 1 through 3.
Figure 5:
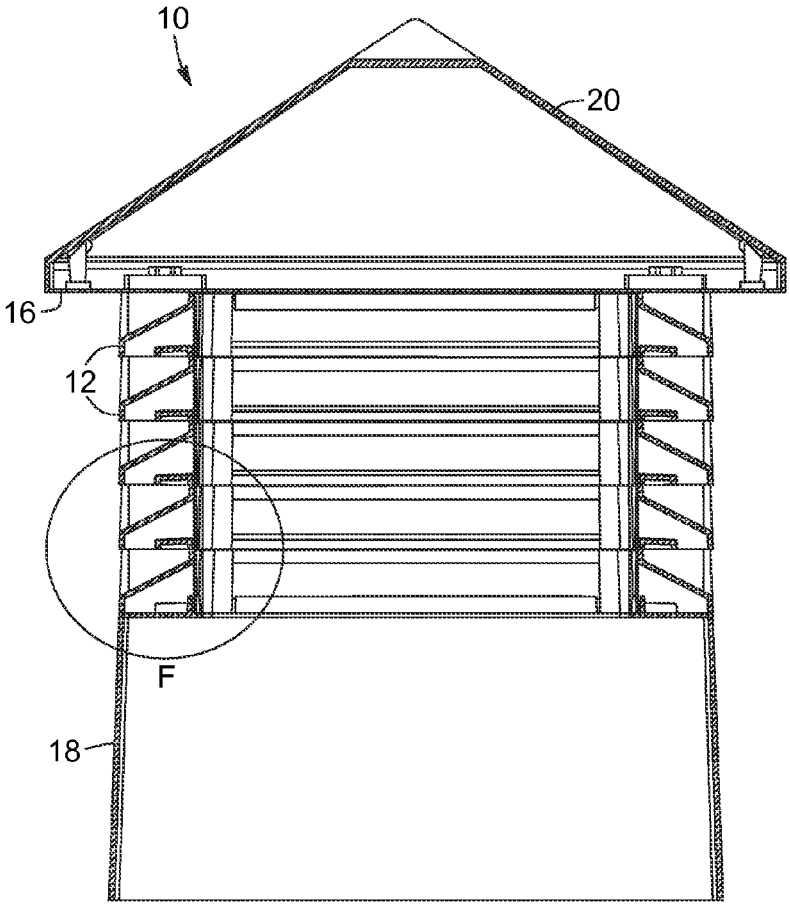
FIG. 5: in a cross-sectional view taken along arrows B-B of FIG. 3, illustrates some of the features of the static roof ventilator shown in FIGS. 1 through 4.
Figure 6:
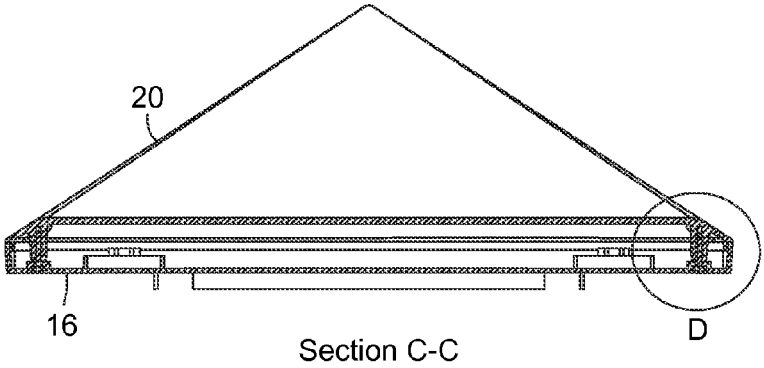
FIG. 6: in a cross-sectional view taken along arrows C-C of FIG. 3, illustrates some of the features of the static roof ventilator shown in FIGS. 1 through 5.
Figure 7:
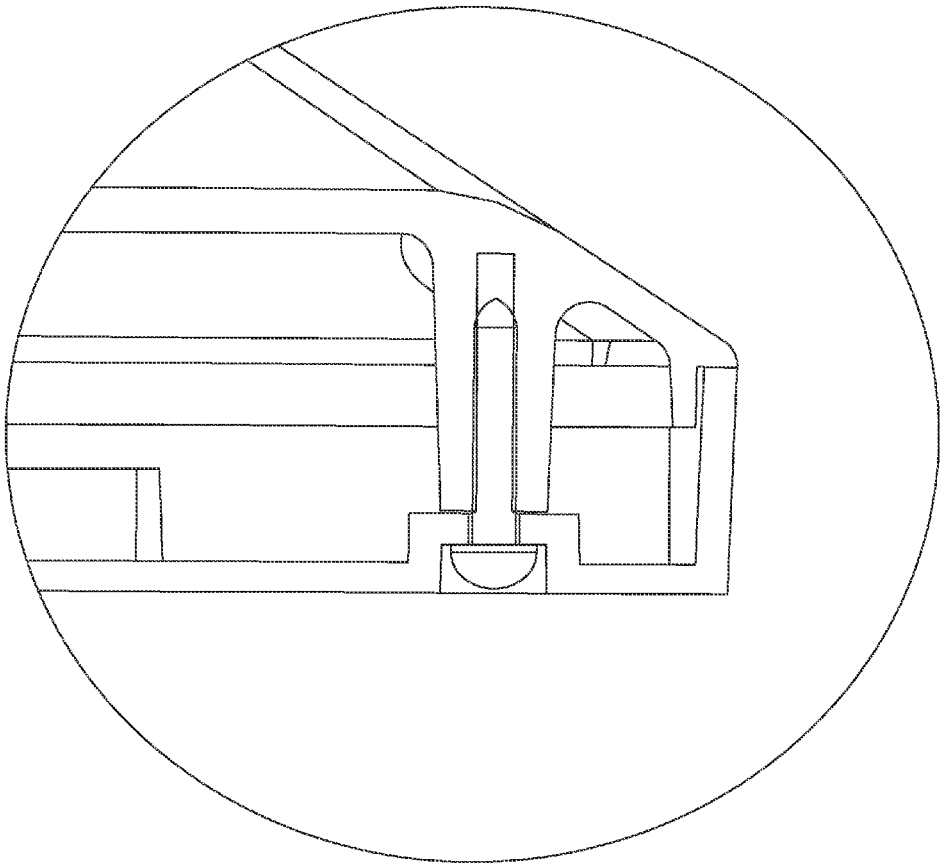
FIG. 7: in a partial view taken inside circle "D" of FIG. 6, illustrates the connection between a cap and a louver component, both part of the static roof ventilator shown in FIGS. 1 through 6.

Referring to FIG. 1, the roof ventilator 10 is a modular roof ventilator that may be assembled using modules 12. More specifically, the roof ventilator 10 includes modules 12, a base 18 attachable to a roof for supporting the modules 12 onto the roof and an end plate 16 located opposed to the base 18. The modules 12 are located between the end plate 16 and the base 18.

The modules 12, the end plate 16 and the base 18 are secured to each other using fasteners 26. Furthermore, the roof ventilator 10 includes a ventilator passageway 14 (better shown in FIG. 2) defining a passageway longitudinal axis. The ventilator passageway 14 is in fluid communication with an interior or a house to which the roof ventilator 10 is attached.

Each of the modules 12 defines a module passageway 13 that is part of the ventilator passageway 14. Each of the modules passageways 13 defines a respective longitudinal axis that is substantially parallel to the passageway longitudinal axis. The module passageways 13 are in fluid communication with each other to form the passageway 14.

Each module 12 includes a louver component 28, better shown in FIGS. 10-14, including louver supports 32 that extend substantially parallel to the passageway longitudinal axis and louvers 34 for creating a draft within the module passageways 13 upon wind blowing onto the louver component 28. The louvers 34 extend from the louver support 32 and are located peripherally relatively to the module passageway 13.

The fastener 26 is operatively coupled to the modules 12 for attaching the modules 12 to each other and biasing the louver supports 32 towards each other.

In some embodiments of the invention, the louver component 28 has a substantially polygonal cross-sectional configuration, for example a substantially square configuration. The louver component 28 is located peripherally relatively to the module passageway 13.

In some embodiments of the invention, at least some of the modules 12 include a baffle component 30, better shown in FIGS. 15-19. For example, the baffle component 30 has the substantially polygonal cross-sectional configuration of the louver component 28. The baffle component 30 is located between adjacent louver components 28 of adjacent modules 12, as seen in FIG. 1.

Returning to FIGS. 15-19, the baffle component 30 includes baffle supports 36 located substantially in register with the louver supports 32 and baffles 38 extending between the baffle support 36. The baffles 38 extend into the wind deflected by the louver components 28, thereby preventing particles carried by the wind from entering the module passageway 13.

In some embodiments of the invention, the polygonal cross-sectional configuration is an n-sided polygonal cross-sectional configuration having n vertices and n sides extending between adjacent vertices, n being an integer greater than 2. The louver components 28 each include n louver supports 32, each extending substantially parallel to the passageway longitudinal axis 24. In addition, each louver component 28 includes n louvers 34 for creating a draft within the module passageway 13 upon wind blowing onto the louvers 34. The louvers 34 each extend between a respective pair of adjacent louver supports 32. Similarly, each of the baffle components 30 includes n baffle supports 36 and n baffles 38, each baffle extending between a respective pair of adjacent baffle supports 36.

In some embodiments, the baffle components 28 and the louver components 30 are separately molded using a single polymeric material. However, in other embodiments of the invention, the louver and baffle components 28 and 30 are manufactured in any other suitable manner.

Figure 8:
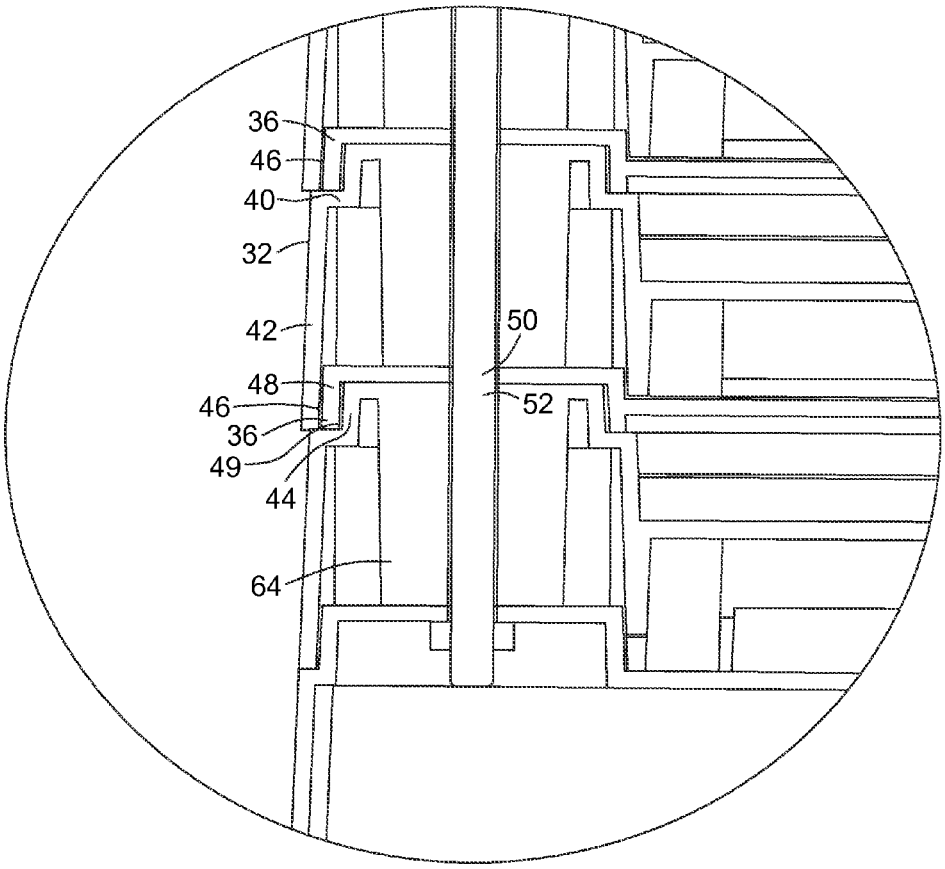
FIG. 8: in a detailed view taken inside circle "E" of FIG. 4, illustrates the relationship between louver and baffle components both part of a static roof ventilator in accordance with the present invention.
Figure 9:
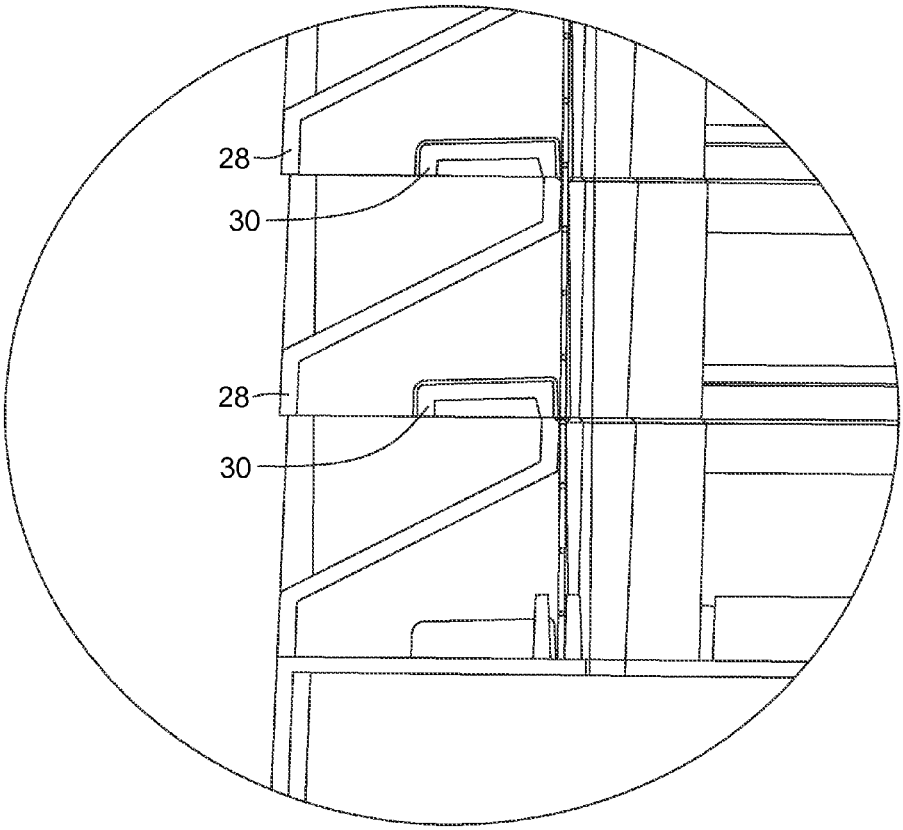
FIG. 9: in a detailed view taken inside circle "F" of FIG. 5, illustrates the relationship between louver and baffle components part of the static roof ventilator shown in FIGS. 1 through 8.

Referring to FIG. 8, each of the louver supports 32 includes a support end wall 40 extending substantially perpendicularly to the passageway longitudinal axis and a support peripheral wall 42 extending substantially outwardly from the support end wall 40. The baffle components 30 abut against the support end wall 40 and include a baffle component protrusion 48 extending substantially away from the module peripheral wall 42. Also, the support end wall 40 defines a module recess 46 for receiving a baffle component protrusion 48 of an adjacent module 12.

In some embodiments of the invention, when the louver and baffle components 28 and 30 are manufactured separately from each other, the baffle component 30 includes a baffle component recess 49 located substantially opposed to the baffle component protrusion 48. In addition, the support end wall 40 includes a louver component protrusion 44 extending substantially away from the support peripheral wall 42. The louver component protrusion 44 engages the baffle component recess 48.

In some embodiments of the invention, the end plate 16, base 18 and modules 12 are secured to each other using a fastener 26 having a substantially elongated fastening member 54. For example, the fastening member 54 includes a bolt 56 and a nut 58 threadable onto the bolt 56.

To that effect, the baffle components and louver components 30 and 28 each include respectively a baffle component fastening aperture 50 and a louver component fastening aperture 52. The baffle component fastening apertures and louver component fastening apertures 50 and 52 are substantially in register with each other such as to allow the insertion of the fastening member 54 therethrough. In other words, the fastening apertures are substantially co-linear with each other.

Figure 11:
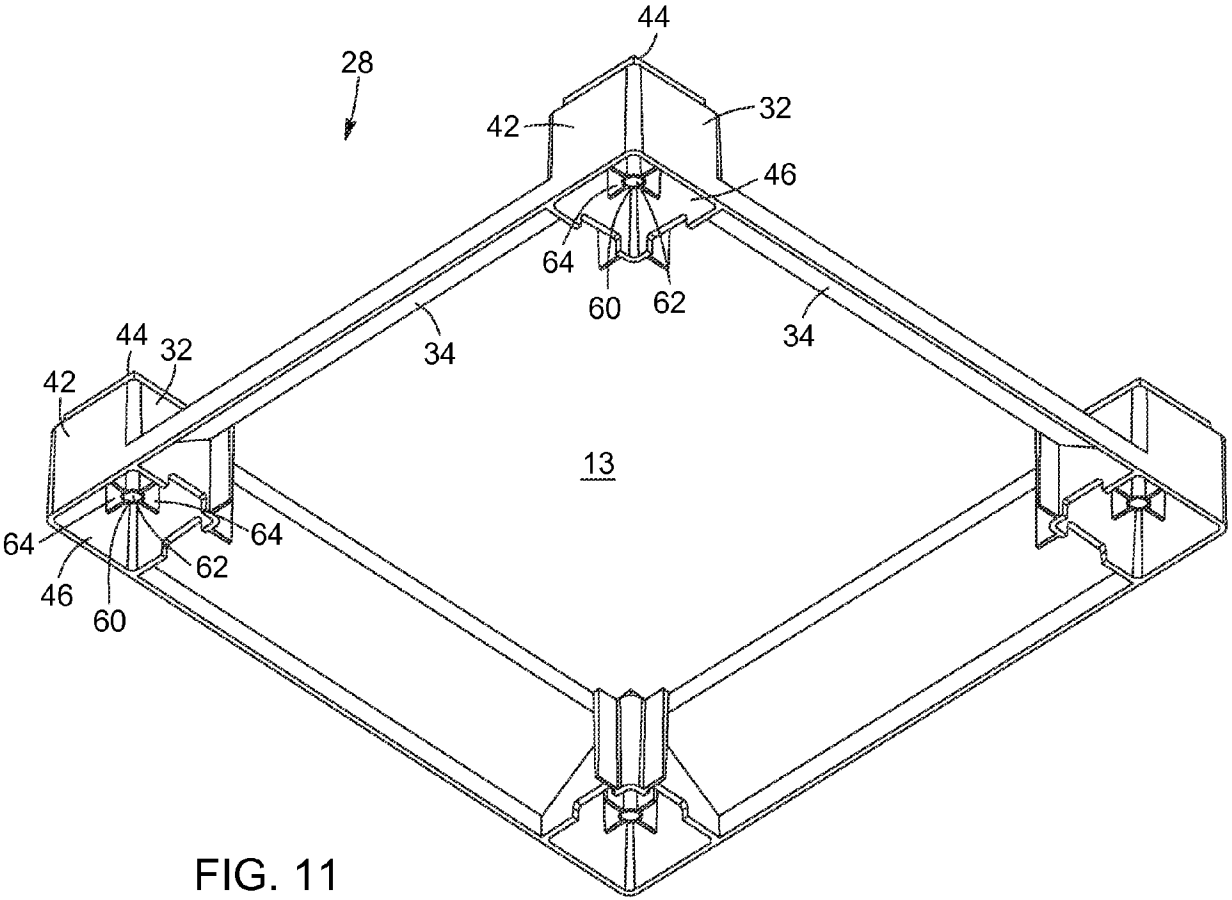
FIG. 11: in a bottom perspective view, illustrates the louver component shown in FIG. 10.
Figure 12:
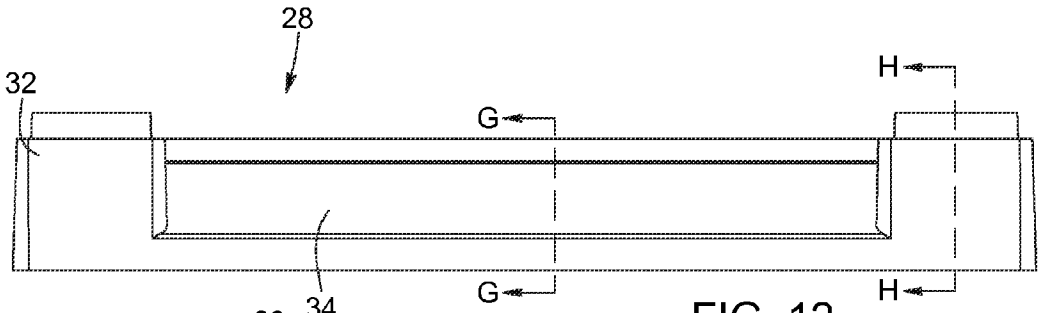
FIG. 12: in an elevational view, illustrates the louver component shown in FIGS. 10 and 11.
Figure 13:
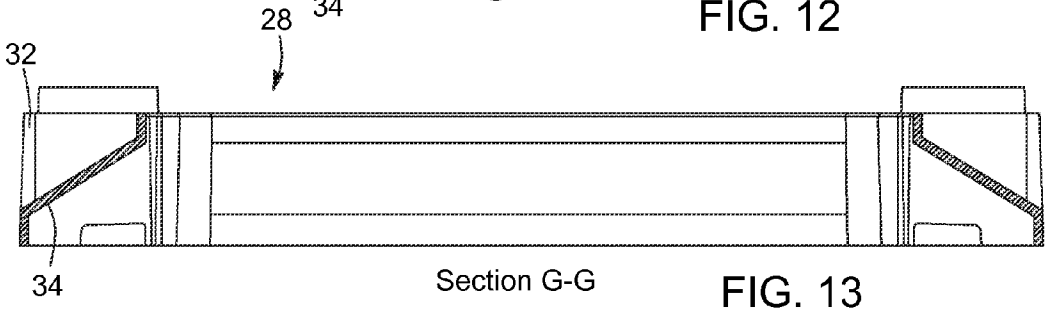
FIG. 13: in a cross-sectional view taken along arrows G-G of FIG. 12, illustrates some of the features of the louver component shown in FIGS. 10 through 12.
Figure 14:
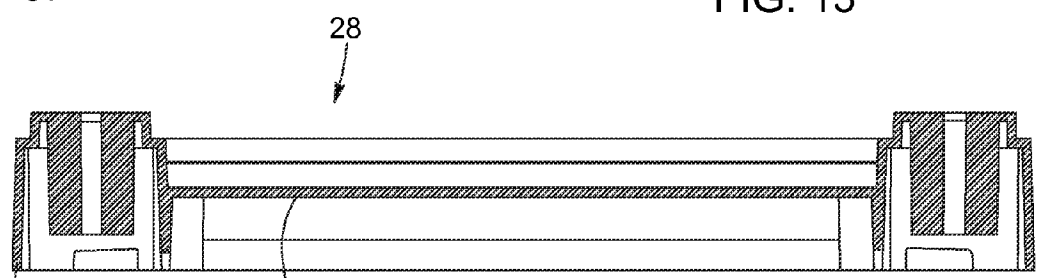
FIG. 14: in a cross-sectional view taken along arrows H-H of FIG. 12, illustrates some of the features of the louver component shown in FIGS. 10 through 13.
Figure 15:
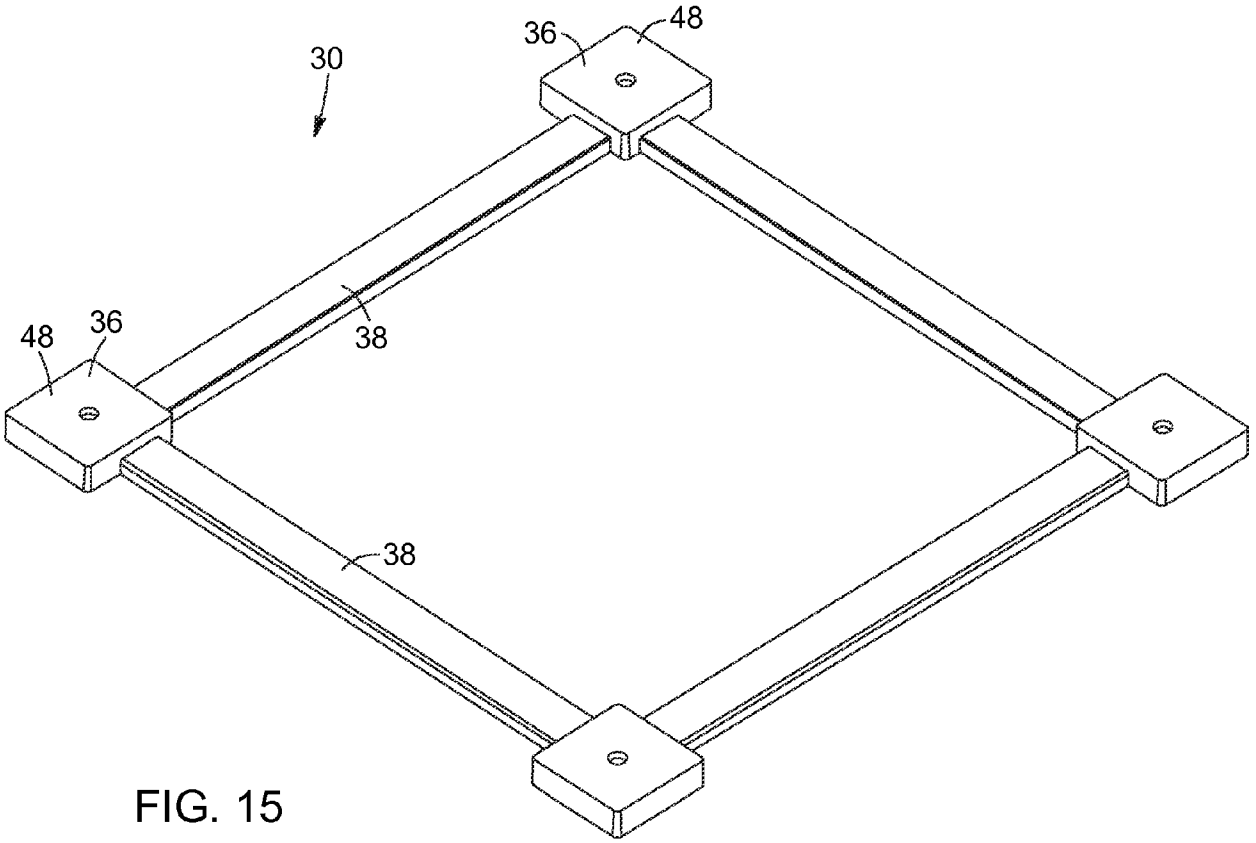
FIG. 15: in a top perspective view, illustrates a baffle component part of the static roof ventilator in accordance with an embodiment of the present invention.
Figure 16:
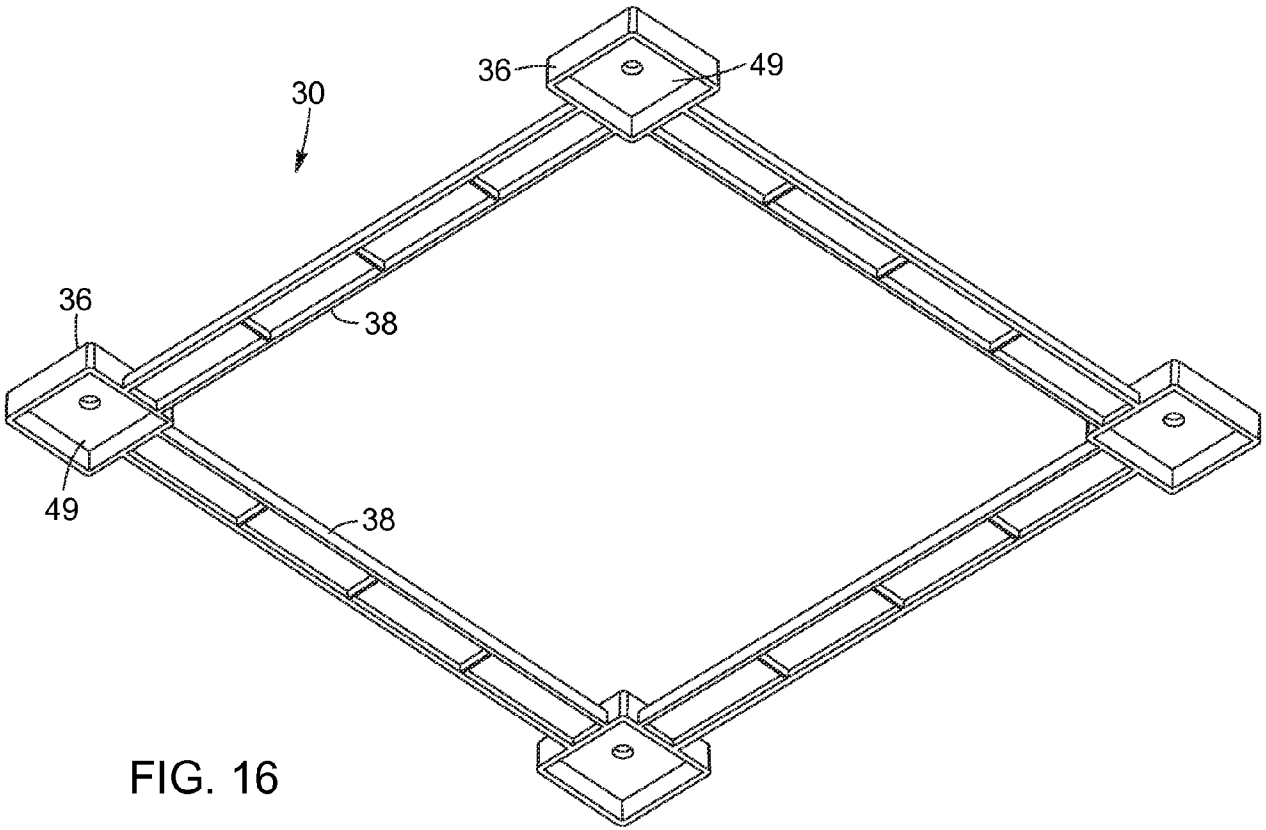
FIG. 16: in a bottom perspective view, illustrates some of the features of the baffle component shown in FIG. 15.
Figure 17:
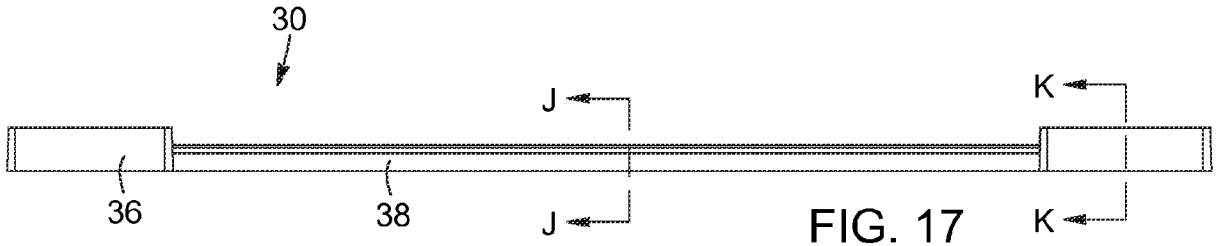
FIG. 17: in an elevational view, illustrates the baffle component shown in FIGS. 15 and 16.

Referring to FIG. 11, in some embodiments of the invention, fastener receiving tubes 60 extend from the support end wall 40 of each of the louver supports 32. The fastener receiving tubes 60 each define a receiving tube passageway 62 extending therethrough for receiving the fastening member 54. The fastener receiving tube 60 is substantially parallel to the passageway longitudinal axis.

In some embodiments of the invention, support internal flanges 64 extend from the support end wall 40 inside the support peripheral wall 42 towards an adjacent module 12 for abutting against this module 12, as seen in FIG. 8. Furthermore, in some embodiments of the invention, support external flanges 62 extend from the support peripheral wall 42 between adjacent baffle components 30. The support internal and external flanges 64 and 62 resist compressive forces that may be exerted by the fastener 26 onto the modules 12 when the nut 58 is threaded onto the bolt 56.

As seen in FIG. 1, the base 18 includes an end surface 70 that is substantially similarly shaped like a surface of the baffle components 30 so as to be able to be attachable to one of the louver components 28. Also, the base 18 includes base fastening apertures 70 located substantially in register with the baffle and louver component fastening apertures 50 and 52.

Also, the end plate 16 extends substantially in register with the ventilator passageway and includes end plate apertures 70 located substantially in register with the baffle and louver components fastening apertures 50 and 52.

In some embodiments of the invention, all the louver components 28 extend in respective louver planes that are substantially perpendicular to the passageway longitudinal axis 24. Also, all the baffle components 30 extend in respective baffle planes that are substantially perpendicular to the passageway longitudinal axis 24.

In some embodiments of the invention, a screen 72 is provided at the periphery of the ventilator passageway 14 and inside the louver and baffle components 28 and 30. The screen 72 is provided for preventing particles, insects and animals from entering inside the ventilator passageway 14.

The louvers 28 may take the form of louver plates angled at an angle of from about 30 degrees to about 60 degrees relatively to the passageway longitudinal axis. In a specific embodiment of the invention, the louver plate is angled at about 45 degrees relatively to the passageway longitudinal axis.

Figure 10:
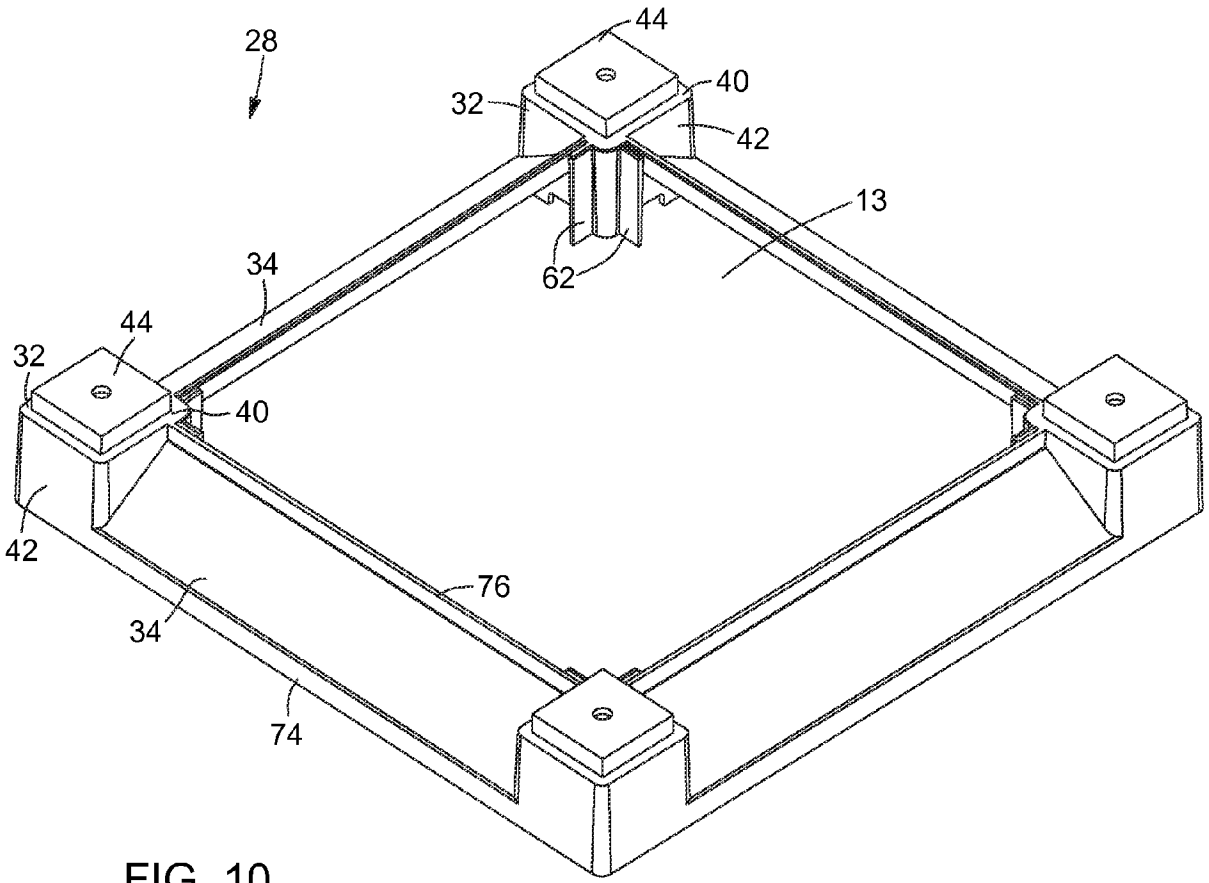
FIG. 10: in a top perspective view, illustrates a louver component part of a static roof ventilator in accordance with an embodiment of the present invention.

Referring to FIG. 10, in some embodiments of the invention, each of the louver components 28 includes an outwardmost rim wall 74 and an inwardmost rim wall 76 that are substantially parallel to each other and substantially parallel to the passageway longitudinal axis. The outwardmost rim wall 74 and inwardmost rim wall 76 extend from the louvers 34 on opposed sides thereof.

In some embodiments of the invention, the support peripheral walls 42 are each tapered in a direction leading respectively towards their support end walls 40. In these embodiments, each of the louver components 30 has therefore a configuration in which the cross-sectional area occupied by the louver component 30 diminishes in a direction leading towards the support end walls 40.

Figure 18:
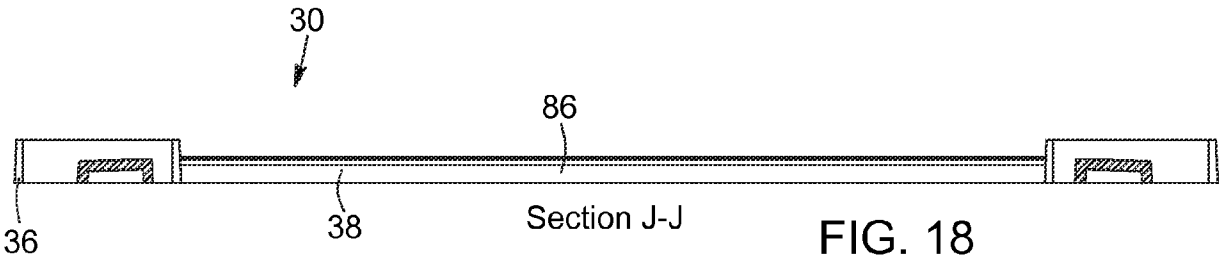
FIG. 18: in a cross-sectional view taken along arrows J-J of FIG. 17, illustrates some of the features of the baffle component shown in FIGS. 15 through 17.
Figure 19:
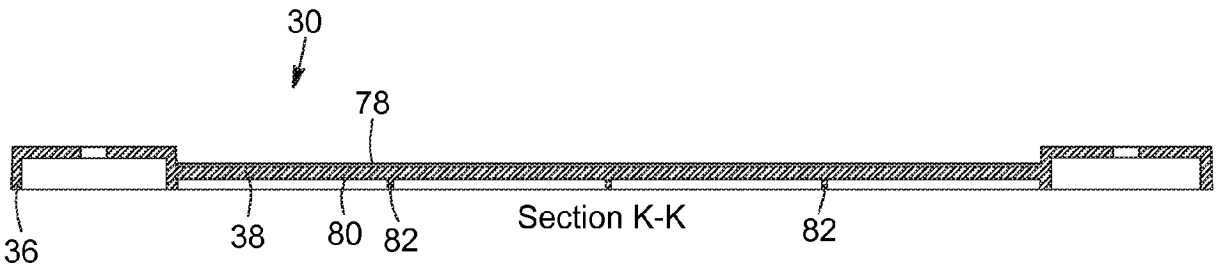
FIG. 19: in a cross-sectional view taken along arrows K-K of FIG. 17, illustrates some of the features of the baffle component shown in FIGS. 15 through 18.
Figure 20:
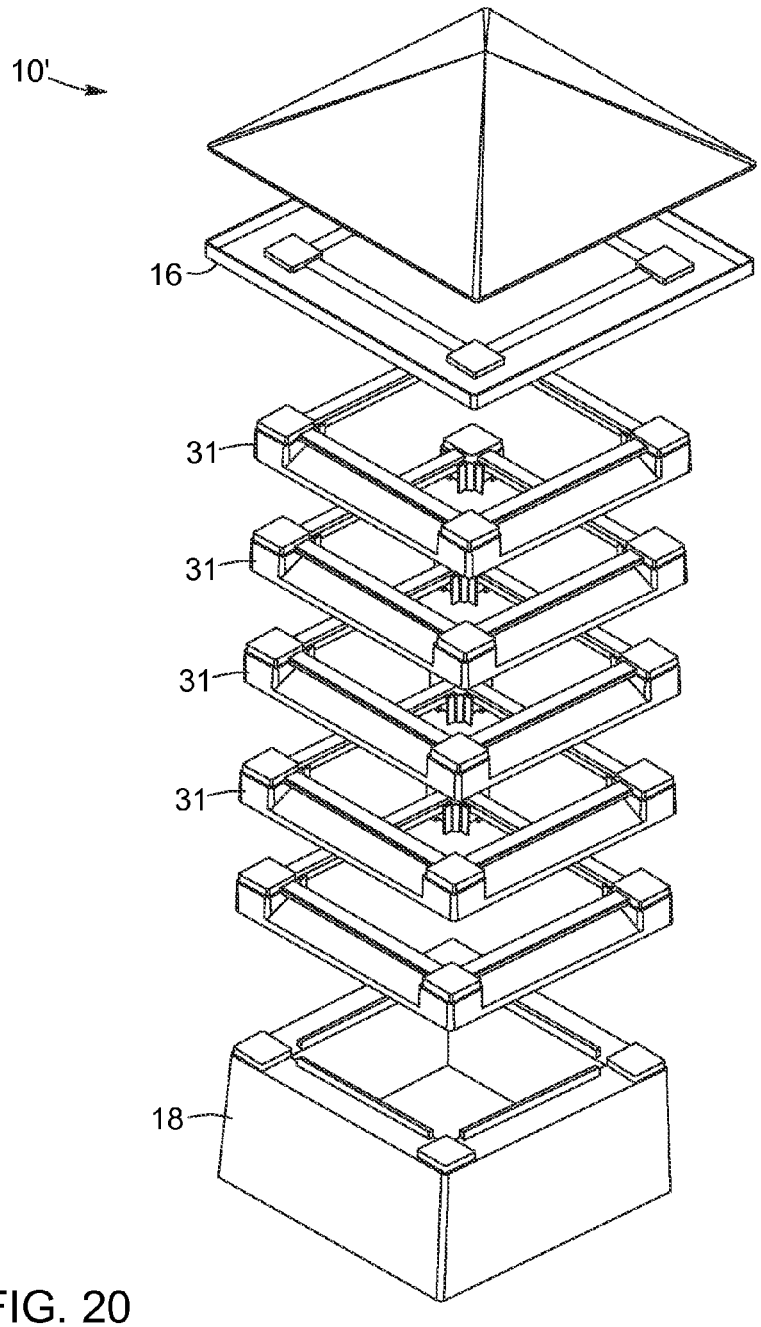
FIG. 20: in an exploded view, illustrates a modular roof ventilator in accordance with a second embodiment of the present invention.
Figure 21:
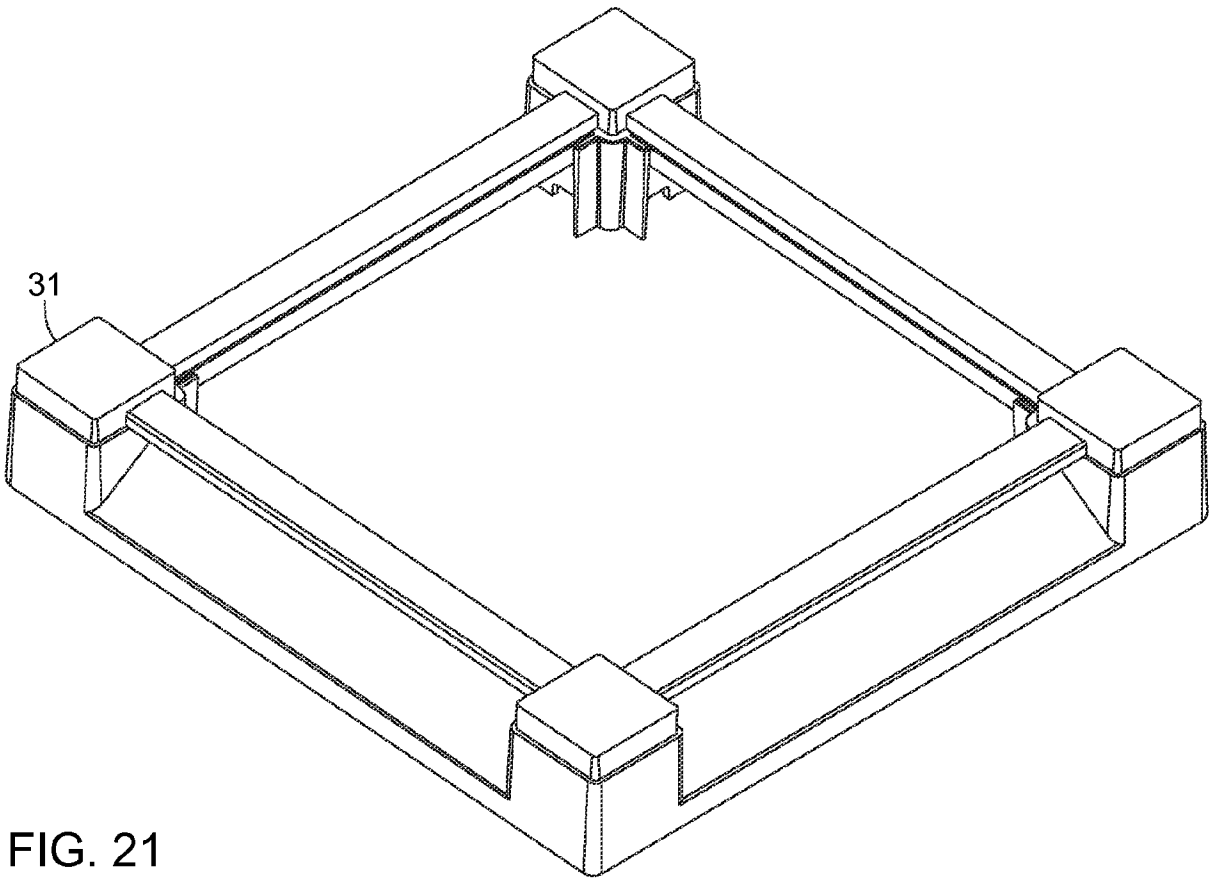
FIG. 21: in a top perspective view, illustrates a combination louver and baffle component part of the roof ventilator shown in FIG. 20.
Figure 22:
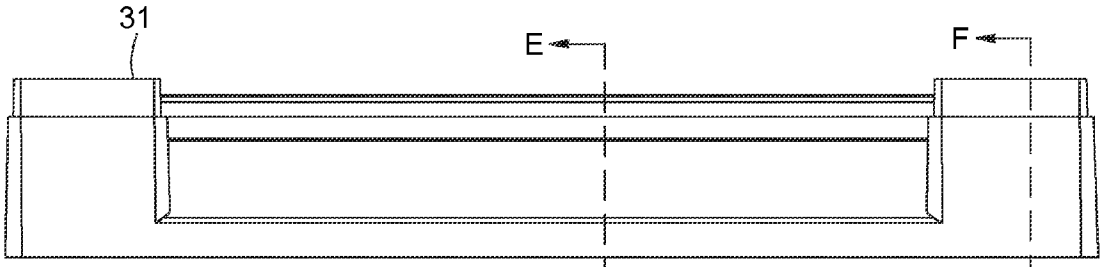
FIG. 22: in an elevational view, illustrates the combination louver-baffle component shown in FIG. 21.
Figure 23:
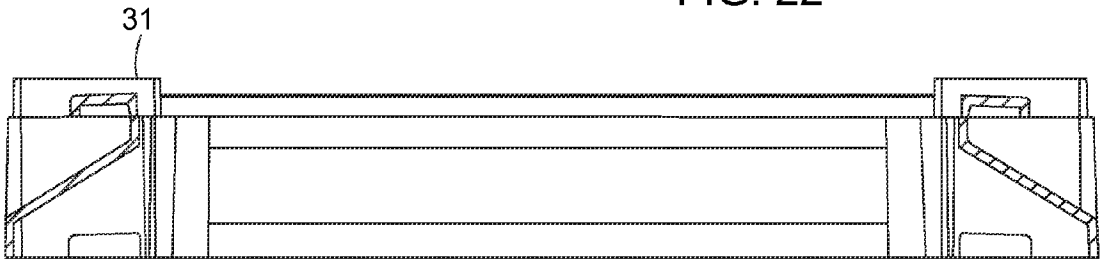
FIG. 23: in a cross-sectional view taken along arrows E-E of FIG. 22, illustrates some of the features of the combination louver-baffle component shown in FIGS. 21 and 22.
Figure 24:
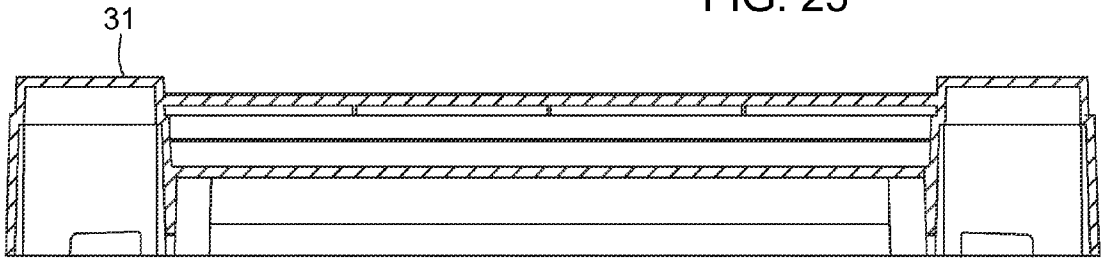
FIG. 24: in a cross-sectional view taken arrows F-F of FIG. 22, illustrates some of the features of the combination louver-baffle component shown in FIGS. 21 through 23.

Referring to FIG. 19, in some embodiments of the invention, the baffle components 30 are substantially planar and define a baffle first surface 78 and a substantially opposed baffle second surface 80. The baffle second surface 80 includes baffle ribs 82 for reinforcing the baffles 38. Furthermore, each of the baffles 38 includes a baffle rim 86 located peripherally relatively to the baffle plate, as seen in FIG. 18. For example, each of the baffles 38 takes the form of a baffle plate extending substantially in register with the louvers 34 and substantially perpendicularly to the passageway longitudinal axis.

The cap 20 is substantially pyramidal and is fixed to the end plate 16 using fasteners 88, such as, for example, screws. In addition to presenting a relatively pleasant aesthetic aspect, the cap 20 also reduces turbulence around the roof ventilator 10 so as to improve the efficiency of the roof ventilator 10.

In use, the roof ventilator 10 is manufactured and brought disassembled to a construction site. Then, an intended user may relatively easily select the number of modules 12 that he wishes to use to assemble the roof ventilator 10. Subsequently, the modules 12 are superposed on top of each other with their baffle and louver component fastening apertures 50 and 52 substantially in register with each other. Afterwards, the bolt 56 is inserted through the end plate apertures 70 and the cap 20 is secured to the plate. Afterwards, the bolts 56 are inserted through the baffle and louver component fastening apertures 50 and 52 of all the modules and through the base securing apertures 71, where they are accessible for threading the nut 58 thereonto.

The shape of the louver and baffle components 28 and 30 is such that they are relatively easily stackable in a relatively compact fashion. Therefore, they are relatively easily transported in a relatively small volume. In addition, the configuration of the baffle and louver components 28 and 30 allow for relatively easily molding of these components using simple moulds. Therefore, this brings cost effectiveness into the manufacturing and shipment of these components.

The fasteners 26 bias the modules 12 towards each other. The flanges 62 and 64 resist compressive force such that a relatively large compressive force may be applied by the fastener 26 onto the modules 12. Therefore, the roof ventilator 10 is relatively solid and rigid and may resist relatively large external forces. The baffle and louver supports 36 and 32 resist compressive forces exerted onto the roof ventilator 10, while the fastener 26 resists tension and shear forces that may be exerted onto the roof ventilator 10.

It should also be understood that some of the components shown in FIGS. 1 through 19 may be assembled together integrally without departing from the scope of the present invention. For example, FIGS. 20 through 24 illustrate a ventilator 10' in accordance with an alternative embodiment of the invention. The ventilator 10' is substantially similar to the ventilator 10 and, hence, similar reference numerals will be used to denote similar components. One of the main differences between the ventilators 10 and 10' resides in that each combination of louver and baffle components 28 and 30 of the ventilator 10 has been merged into a corresponding integral louver-base component 31. Also, FIG. 25 illustrates a ventilator 10" in accordance with yet another alternative embodiment of the invention wherein the base 18, the louver and baffle components 28 and 30 and the end plate 16 have all been merged into an integral tower component 33.

Figure 25:
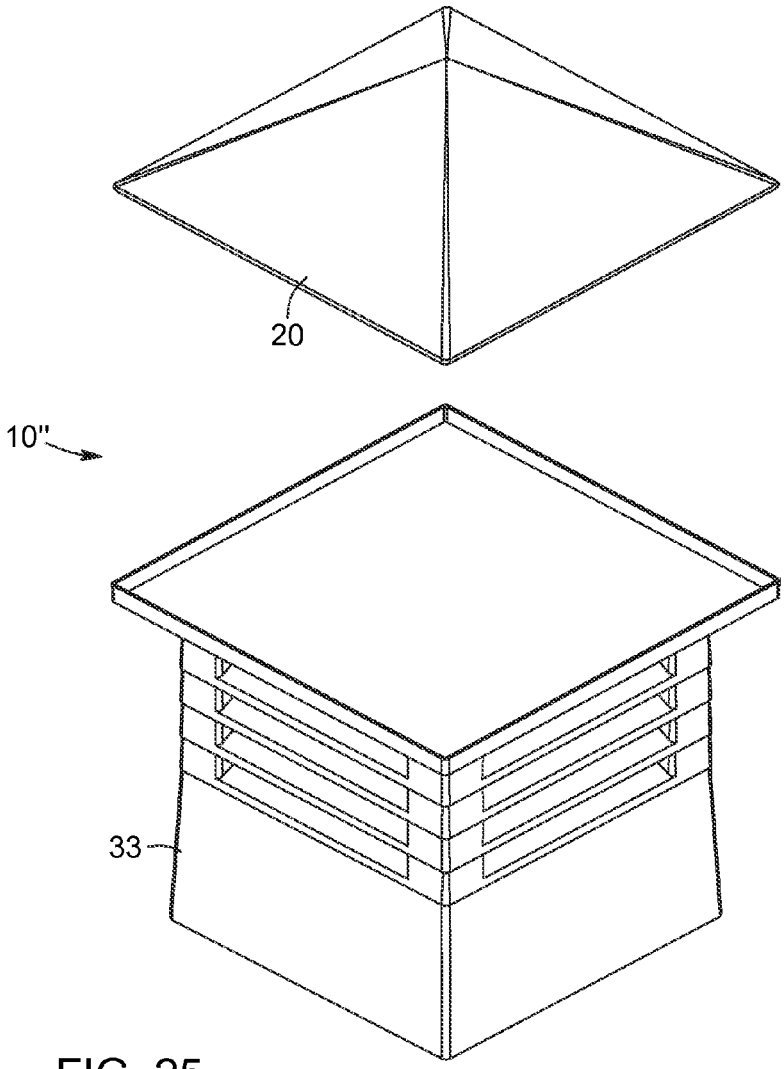
FIG. 25: in an exploded view, illustrates the static roof ventilator in accordance with a third embodiment of the present invention.

In some embodiments of the invention, as seen in FIG. 25, alternative roof ventilators 12 include alternative modules wherein the louver and baffle components 28 and 30 extend integrally from each other.

Although the present invention has been described hereinabove by way of preferred embodiments thereof, it can be modified, without departing from the spirit and nature of the subject invention as defined in the appended claims.

What is claimed is:

1. A roof ventilator, comprising:

a first module defining a first module passageway, said first module passageway defining a first passageway longitudinal axis, said first module including:

a first module louver support extending substantially parallel to said first passageway longitudinal axis, a first module louver for creating a draft within said first module passageway upon wind blowing onto said first module louver, said first module louver extending from said first module louver support, said first module louver being located peripherally relatively to said first module passageway, and a first module baffle, extending into wind deflected by the first module louver, for preventing particles carried by the wind from entering the first module passageway;

a second module stackable on said first module, said second module defining a second module passageway when in use, said second module passageway being in fluid communication with said first module passageway and defining a second passageway longitudinal axis, said second module including:

a second module louver support, said second module louver support extending substantially parallel to said second passageway longitudinal axis, and a second module louver for creating a draft within said second module passageway upon wind blowing onto said second module louver, said second module louver extending from said second module louver support, and comprising an obliquely-angled lower surface and a distal end, said second module louver being located peripherally relatively to said second module passageway; and a fastener operatively couplable to said first and second modules for attaching said first and second modules to each other and biasing said first and second module louver supports towards each other, wherein the first module baffle extends horizontally into an airspace defined between the obliquely-angled lower surface of the second module louver and a plane extending from the distal end at a 90 degree angle relative to the first passageway.

2. A roof ventilator as defined in claim 1, wherein:

said first module includes a first module louver component having a substantially polygonal cross-sectional configuration, said first module louver component being located peripherally relatively to said first module passageway, said first module louver component including said first module louver and said first module louver support; and said second module includes a second module louver component having said substantially polygonal cross-sectional configuration, said second module louver component being located peripherally relatively to said second module passageway, said second module louver component including said second module louver and said second module louver support.

3. A roof ventilator as defined in claim 2, wherein said first module includes a first module baffle component having said substantially polygonal cross-sectional configuration, said first module baffle component including said first module baffle, said first module baffle component being stackable on top of said first module louver support.

4. A roof ventilator as defined in claim 3, wherein:

said first module louver support includes a first support end wall extending substantially perpendicularly to said first passageway longitudinal axis and a first support peripheral wall extending substantially outwardly from said first support end wall;

said first baffle component abuts against said first support end wall and includes a first baffle component protrusion extending substantially away from said first module peripheral wall; and said second module louver support includes a second support end wall extending substantially perpendicularly relatively to said second passageway longitudinal axis and a second support peripheral wall extending substantially outwardly from said second support end wall towards said first module, said second support end wall defining a second module recess receiving said first baffle component protrusion.

5. A roof ventilator as defined in claim 4, wherein:

said first baffle component includes a first baffle component recess located substantially opposed to said first baffle component protrusion; and said first support end wall includes a first louver component protrusion extending substantially away from said first support peripheral wall, said first louver component protrusion engaging said first baffle component recess.

6. A roof ventilator as defined in claim 3, wherein said first baffle component extends integrally from said first louver component.

7. A roof ventilator as defined in claim 3, wherein:

said first baffle component, said first louver component and said second louver component include respectively a first baffle component fastening aperture, a first louver component fastening aperture and a second louver component fastening aperture, said first baffle component fastening aperture, said first louver component fastening aperture and said second louver component fastening aperture being substantially collinear with each other; and said fastener includes a substantially elongated fastening member extending through said first louver component fastening aperture, said first baffle component fastening aperture and said second louver component fastening aperture.

8. A roof ventilator as defined in claim 7, wherein said second module louver support includes a flange extending from said second support end wall inside said second support peripheral wall, said flange abutting against said first module.

9. A roof ventilator as defined in claim 4, wherein said first and second support peripheral walls are each tapered in a direction leading respectively towards said first and second support end walls.

10. A roof ventilator as defined in claim 4, wherein said first module louver includes a louver plate extending from said first support peripheral wall.

11. A roof ventilator as defined in claim 10, wherein said louver plate is angled at from about 30 degrees to about 60 degrees relatively to said first passageway longitudinal axis.

12. A roof ventilator as defined in claim 10, wherein said first module baffle component includes a baffle plate extending substantially in register with said louver plate.

13. A roof ventilator as defined in claim 12, wherein said baffle plate is substantially perpendicular to said first passageway longitudinal axis.

14. A roof ventilator as defined in claim 2, wherein:

said polygonal cross-sectional configuration is an n-sided polygonal cross-sectional configuration having n vertices and n sides extending between adjacent vertices, n being an integer greater than 2;

said first module louver includes n first module louver supports each extending substantially parallel to said first passageway longitudinal axis; and n first module louvers for creating a draft within said first module passageway upon wind blowing onto said first module louvers, said first module louvers each extending between a respective pair of adjacent module louver supports.

15. A roof ventilator as defined in claim 2, wherein said first and second module louver components each extend respectively in a first and a second louver plane, said first and second louver planes being substantially perpendicular respectively to said first and second passageway axes.

16. A roof ventilator as defined in claim 1, further comprising an end plate attached to said second module substantially opposed to said first module, said end plate extending substantially in register with said second module passageway.

17. A roof ventilator as defined in claim 1, further comprising a base attached to said first module for attaching said roof ventilator to a roof.

18. A roof ventilator as defined in claim 1, wherein said first and second modules are each made essentially of a polymer.

19. A roof ventilator as defined in claim 3, wherein said first module baffle component is reversibly attachable to said first and second module louver components.

20. A roof ventilator as defined in claim 7, wherein said elongated fastening member vertically extends along an entire-height of the first and second modules, thereby increasing resistance of said roof ventilator to tension and shear forces exerted thereon.

21. A roof ventilator as defined in claim 1, wherein the second module louver overhangs the first module baffle, the first module baffle and the second module louver having respective horizontal transverse widths, said width of the first module baffle being about half of said width of the second module louver.

* * * * *